US007308988B2

(12) United States Patent
Yashima et al.

(10) Patent No.: US 7,308,988 B2
(45) Date of Patent: Dec. 18, 2007

(54) CAP

(75) Inventors: Noboru Yashima, Tokyo (JP); Takeshi Omi, Tokyo (JP); Mitsuo Yamanoi, Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/307,318

(22) Filed: Dec. 2, 2002

(65) Prior Publication Data

US 2004/0104193 A1 Jun. 3, 2004

(51) Int. Cl.
*B65D 47/12* (2006.01)
*B67D 3/00* (2006.01)

(52) U.S. Cl. ..... 215/344; 222/546; 222/547

(58) Field of Classification Search ..... 215/329, 215/344, 343; 222/546, 547
See application file for complete search history.

(56) References Cited

U.S. PATENT DOCUMENTS 2,715,480 A * 8/1955 Livingstone ..... 222/111
RE24,695 E * 9/1959 Kirschenbaum ..... 222/421
3,099,361 A * 7/1963 Ruetz ..... 215/345
3,319,842 A * 5/1967 Miller ..... 222/479
3,563,422 A * 2/1971 Cruikshank ..... 222/478
3,762,612 A * 10/1973 Miller ..... 222/479
3,860,152 A * 1/1975 Marti ..... 222/545
3,980,211 A * 9/1976 Owens ..... 222/478
4,171,749 A * 10/1979 Obrist et al. ..... 215/256
4,433,800 A * 2/1984 Owens ..... 222/547
4,475,274 A * 10/1984 Beckstrom et al. ..... 29/450
4,494,682 A * 1/1985 Beckstrom et al. ..... 222/551
4,600,131 A * 7/1986 Roof et al. ..... 222/478
4,936,494 A * 6/1990 Weidman ..... 222/480
5,275,287 A * 1/1994 Thompson ..... 215/344
5,454,489 A * 10/1995 Vesborg ..... 222/109
5,769,255 A * 6/1998 Ohmi et al. ..... 215/345
5,785,209 A * 7/1998 Guglielmini ..... 222/153.07
5,967,352 A * 10/1999 Repp et al. ..... 215/256
5,975,321 A * 11/1999 Luch ..... 215/256

(Continued)

FOREIGN PATENT DOCUMENTS

EP 0 508 668 10/1992

(Continued)

*Primary Examiner*—Anthony D. Stashick
*Assistant Examiner*—James Smalley
(74) *Attorney, Agent, or Firm*—Oblon, Spivak, McClelland, Maier & Neustadt, P.C.

(57) ABSTRACT

A cap 10 which has a female screw 14 in the inner peripheral surface and which is to be screwed on a port neck part 13 of a container main body 11 holding a predetermined liquid, wherein a plurality of ribs 18 radially extending astride from an inner surface of a top surface part 16 of the cap 10 to an inner surface of a peripheral wall part and integrally projecting inwards are formed on a peripheral edge part 17 of the inner surface of the top surface part 16. A female screw 14 is a screw in the form of two threads composed of spiral mated ridges 14*a*, 14*b* of two threads, for example. The liquid held in the container main body 11 is, for example, a chlorine-based bleach which contains a surface active agent and a sodium hypochlorite. The mated ridges 14*a*, 14*b* each are 80 to 120 degrees in thread angle θ and 1 to 15% of a valley radius of the female screw 14 in thread height H.

8 Claims, 4 Drawing Sheets

U.S. PATENT DOCUMENTS 6,382,445 B1 * 5/2002 McCandless ..... 215/341

FOREIGN PATENT DOCUMENTS

| | | |
|---|---|---|
| JP | 58-50218 | 4/1983 |
| JP | 1-69744 | 5/1989 |
| JP | 5-124667 | 5/1993 |
| JP | 9-183452 | 7/1997 |
| JP | 9-252823 | 9/1997 |
| JP | 10-81895 | 3/1998 |
| JP | 11-70949 | 3/1999 |
| JP | 2001-58658 | 3/2001 |

* cited by examiner

CAP

BACKGROUND OF THE INVENTION

1. Field of the Invention

The present invention relates to a cap which is to be attached to a container main body holding a liquid which contains a surface active agent and which is excellent in effect of ESCR (ENVIRONMENTAL STRESS CRACKING RESISTANCE).

2. Description of the Related Art

Liquid containing a surface active agent such as detergent is held in a bottled container made of resin. A cap attached to a port neck part of the container main body is detached, and then the content liquid is used while properly measuring the quantity by the detached cap. After the use of the content liquid, the cap is attached for closing to the port neck part again. In the bottle container of the type as just mentioned, during repetition of the attaching and detaching operation of the cap and/or by measuring the content liquid with the cap, the liquid adheres to the cap. Then, under the adverse effect of the surface active agent and also under the adverse effect of the repeated stress at the time of attaching and detaching operation, the cap is susceptible to get broken by environmental stress crack. Moreover, in case the content liquid is a liquid containing a surface active agent and sodium hypochlorite, the cap more easily gets broken by environmental stress crack, due to synergetic effect of the surface active agent and sodium hypochlorite.

The breakage of the cap due to environmental stress crack is liable to occur by crack which occurs at a specific part of the cap to which the content liquid adheres and a stress is concentratedly applied, such as a joint part between a top surface part and a peripheral wall part or a terminal part on the top surface side of a female thread. According to the conventional related art, it is attempted to prevent the cap from getting broken by increasing the thickness of the such specific part for reinforcement. However, there are such inconveniences that the quantity of resin as the material of the cap is increased and the time for plasticizing and for cooling in a production process such as an injection molding is increased to thereby decrease productivity.

It is an object of the present invention to provide a cap capable of effectively preventing breakage of the cap caused by the environmental stress crack, without a need of increasing the thickness of the cap.

SUMMARY OF THE INVENTION

The present invention has achieved the above object by providing a cap to be attached to a port neck part of a container main body holding a liquid which contains a surface active agent, wherein a plurality of ribs radially extending astride from an inner surface of a top surface part of the cap to an inner surface of a peripheral wall part and integrally projecting inwards are formed on a peripheral edge part of the inner surface of the top surface part.

According to the present invention, it is preferred that a female screw is formed in an inner peripheral surface of the cap and the female screw is a screw in the form of two to four threads composed of spiral ridges to be mated having two to four threads.

According to the cap of the present invention, the cap can effectively be prevented from getting broken due to environmental stress crack without a need of increasing the thickness of the cap.

BRIEF DESCRIPTION OF THE DRAWINGS

FIG. 2 is viewed from under.

FIG. 4(*b*) is a partly enlarged view for explaining a rib.

FIG. 5(*b*) is an enlarged view of an area indicated by A of FIG. 5(*a*).

FIG. 6(*b*) is a development view along an inner peripheral surface of a cap for explaining a screw of two threads of Example 1.

DETAILED DESCRIPTION OF THE INVENTION

Figure 1:
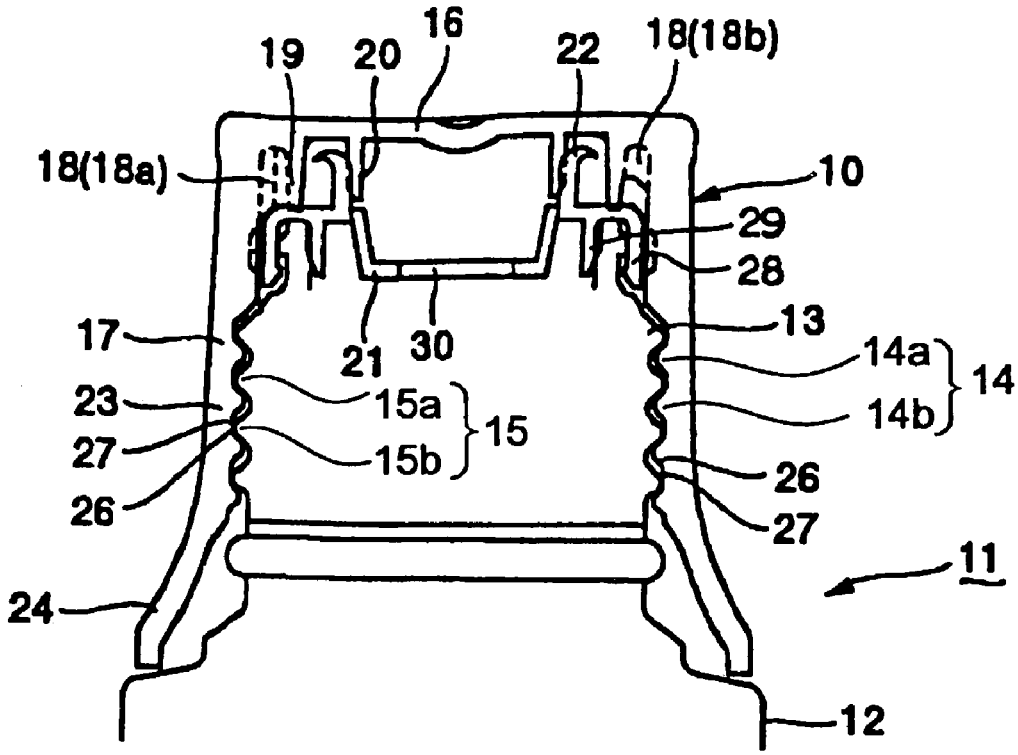
FIG. 1 is a schematic sectional view for explaining a status in which a cap according to one embodiment of the present invention is attached to a port neck part of a container main body.
Figure 2:
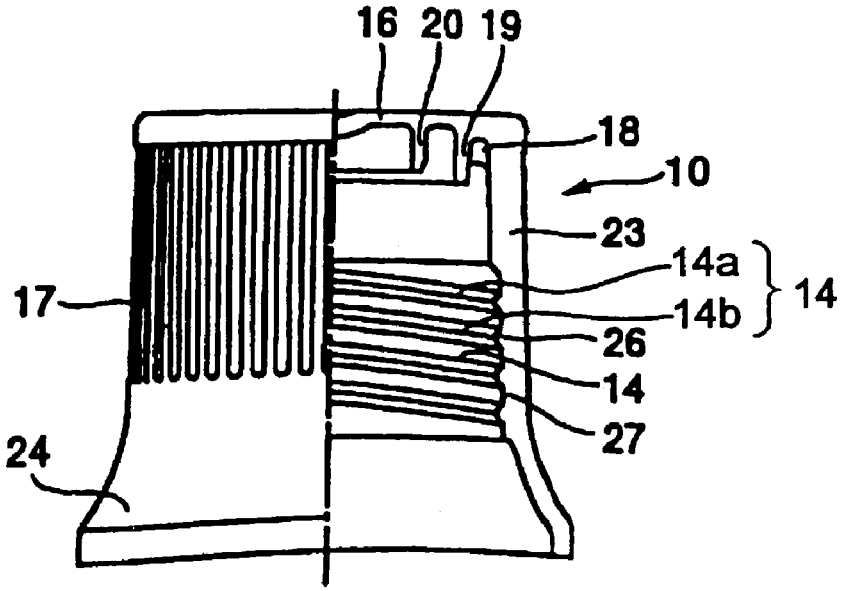
FIG. 2 is a partly cut-away front view showing a cap according to one embodiment of the present invention.

A cap 10 according to a preferred embodiment of the present invention shown in FIGS. 1 through 5 is detachably screwed on a port neck part 13 of a container main body 12 in a polyethylene-made bottle container 11 which contains, for example, a chlorine-based bleach as a content liquid. That is, a female screw 14 is formed in an inner peripheral surface of the cap 10. By screwing the female screw 14 into a male screw 15 which is formed on an outer peripheral surface of the port neck part 13 of the container main body 12, the cap 10 is fixedly attached to the port neck part 13 of the container main body 12.

According to the cap 10 of this embodiment, a plurality of ribs 18 radially extending astride from an inner surface of a top surface part 16 of the cap 10 to an inner surface of a peripheral wall part and integrally projecting inwards are formed on a peripheral edge part of the inner surface of the top surface part 16. That is, the ribs 18 are provided in such a manner as to connect an outer surface of an outer inner ring part 19 with an inner surface of the peripheral wall part 17 (see FIGS. 3 and 4).

Moreover, according to this embodiment, the female screw 14 formed in the inner peripheral surface is a screw in the form of two threads composed of spiral ridges 14*a*, 14*b* of two threads to be mated to the ridges of the male screw. Each of the mated ridges 14*a*, 14*b* composing the female screw 14 is 80 to 120 degrees in thread angle θ and 1 to 15% of a valley radius (radius in a screw bottom) R of the female screw 14 in thread height (height from the screw bottom to the distal end of the screw) H (see FIGS. 5(*a*) and 5(*b*)).

The cap 10 is made of polyethylene and manufactured by injection molding. The cap 10 comprises the circular top surface part 16 and the peripheral wall part 17 extending in the form of a skirt from the peripheral edge part of the top surface part.

The top surface part 16 is a circular planar part having a diameter of about 33 mm. An annular outside inner ring part 19 and an annular inside inner ring part 20 are provided in duplicate to the inner surface of the top surface part 16 in such a manner as to be concentric with the top surface part 16, at locations of diameters of 14 mm and 21.7 mm (values at the center of the thickness of each ring) respectively. The outside inner ring part 19 projects from the inner surface of the top surface part 16 so as to have a height of 4.8 mm and to retain an interval of about 2 mm between the inner surface of the peripheral wall part 17 and the outside inner ring part 19. The inside inner ring part 20 projects from the inner surface of the top surface part 16 so as to have a height of 3.9 mm. At the time of attaching the cap 10 to the port neck part 13 of the container main body 12, the distal end of the outside inner ring part 19 is tightly abutted with the distal end surface of the port neck part 13 in such a manner as to sandwich an inner plug 21 as later described, and the inside inner ring part 20 is tightly inserted in a fitting ring part 22, which is disposed at the inner plug 21, in such a manner as to push and spread the fitting ring part 22. By these mechanism, the container main body 12 is hermetically closed, thereby effectively preventing the leak of the inside chlorine-based bleach.

The peripheral wall part 17 is a circular cylindrical part integrally joined with the peripheral edge part of the top surface part 16. The peripheral wall part 17 comprises a vertical part 23 having a length of about 26 mm and a thickness of about 3 mm, and an enlarged-diameter tapered-part 24 which is continuous with a lower part of the vertical part 23. The female screw 14, which is constituted of the spiral mated ridges 14*a*, 14*b* of two threads, is formed in the inner surface of the vertical part 23 with a remaining interval of about 10 mm at a lower part of the top surface part 16. The outer surface of the vertical part 23 is subjected to knurling so that the finger will not slip at the time of turning the cap 10 (see FIG. 2).

The one pair of mated ridges 14*a*, 14*b*, which constitute the female screw 14 as a screw of two threads, spirally extend each from radially opposing locations, as start points, of the inner peripheral surface at a lower part of the vertical part 23 of the cap 10, towards the top surface part 16 side in such a manner as to alternately overlap with each other, and then, terminate at radially opposing positions as terminal parts.

The mated ridges 14*a*, 14*b* each have a laterally-directed generally tower-footing trapezoidal sectional configuration, and they are 80 to 120 degrees in thread angle θ at their distal ends. Because of the feature that the thread angle θ is 80 to 120 degrees, stress can efficiently be dispersed at the time of tightening the cap to the port neck part 13 of the container main body 12, and favorable feature for molding can be obtained. The mated ridges 14*a*, 14*b* are 1 to 15% of the valley radius R of the female screw 14 in thread height H, respectively. Because of the feature that the thread height H is 1 to 15% of the valley radius R of the female screw 14, the female screw 14 can satisfactorily be engaged with the male screw 15 at the time of tightening the cap 10 to the port neck part 13 of the container main body 12.

The mated ridges 14*a*, 14*b* each have a laterally directed generally tower-footing trapezoidal configuration having a height of about 0.5 to 1.5 mm, and their slant surfaces on the top surface part 16 side and their slant surfaces on the opposite side are brought into contact with the valley bottom part 27 through a R-face 26 which is concavely curved.

Figure 3:
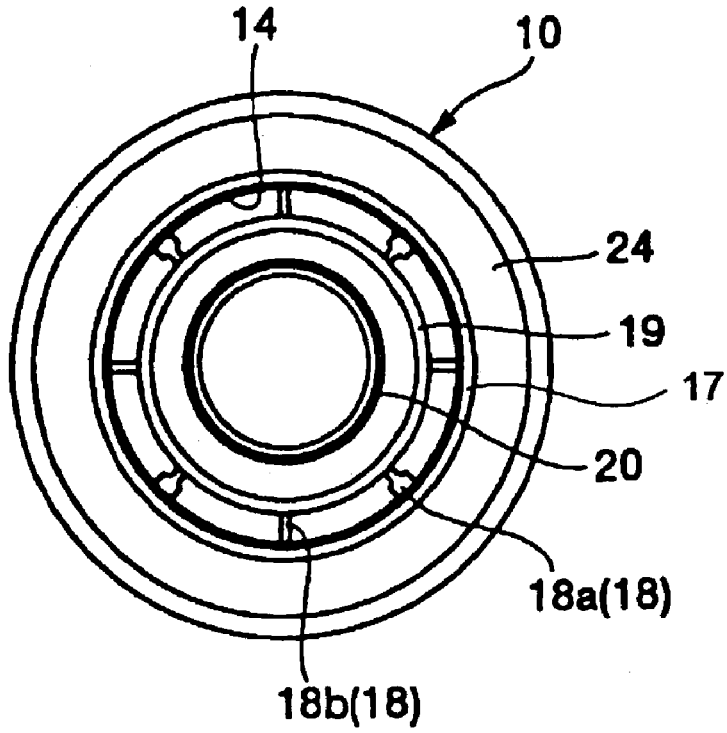
FIG. 3 is a bottom view when
Figure 4:
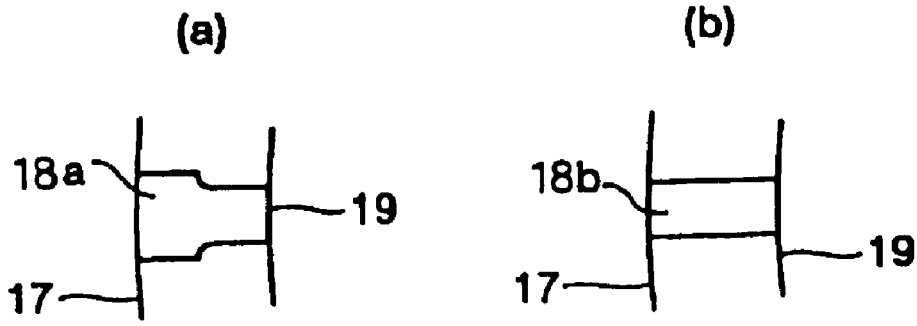
FIG. 4(*a*) is a partly enlarged view for explaining a rib.
Figure 5A:
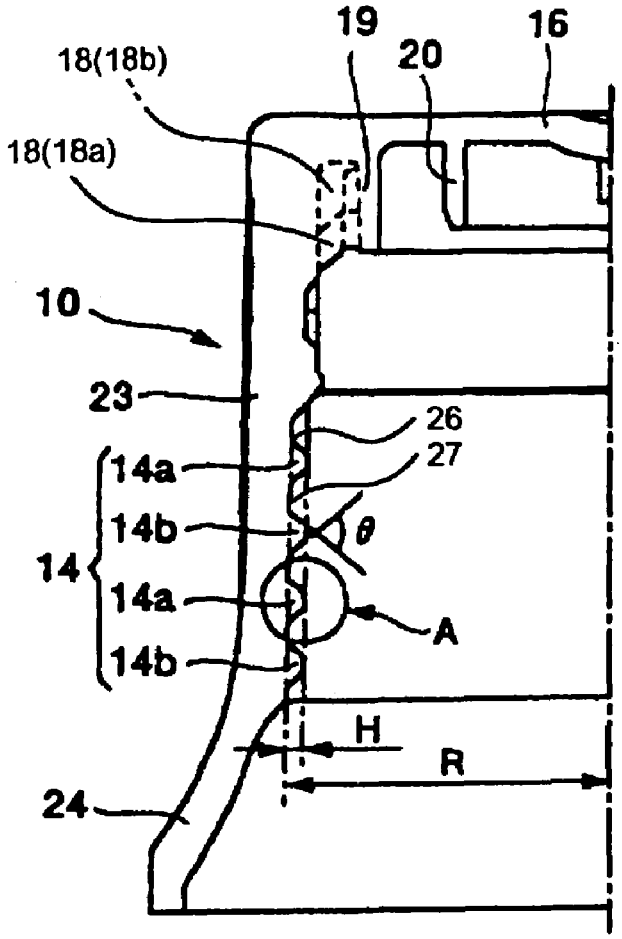
FIG. 5(*a*) is a partly enlarged sectional view of a cap according to one embodiment of the present invention.
Figure 5B:
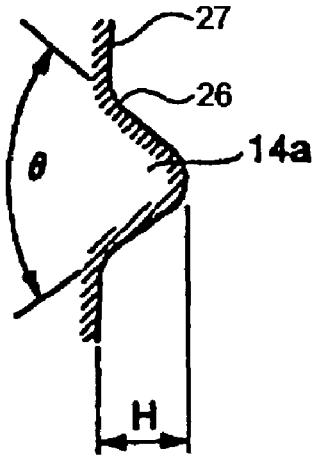

And according to this embodiment, the ribs 18 provided astride from the inner surface of the top surface part 16 to the inner surface of the peripheral wall part 17 are sandwiched between the inner surface of the peripheral wall part 17 and the outer surface of the outside inner ring part 19, and arranged at eight spots at equal intervals of 45 degrees in the circumferential direction of the peripheral edge part of the top surface part 16 (see FIG. 3). The ribs 18 include two kinds of first ribs 18*a* and second ribs 18*b*, and those two kinds of ribs 18*a*, 18*b* are alternately arranged at equal intervals of 90 degrees in the circumferential direction. The first ribs 18*a*, as shown in FIG. 4(*a*), each have a sectional configuration which is 0.8 mm in width on the outside inner ring part 19 side and 1.4 mm in width on the peripheral wall part 17 side, and they are arranged at the space between the inner surface of the peripheral wall part 17 and the outer surface of the outside inner ring part 19 and allowed to extend in the radial direction of the top surface part 16, such that their height from the top surface part 16 is about 4.6 mm. The second ribs 18*b*, as shown in FIG. 4(*b*), each have a sectional configuration which is 0.8 mm in width, and they are arranged at the space between the inner surface of the peripheral wall part 17 and the outer surface of the outside inner ring part 19 and allowed to extend in the radial direction of the top surface part 16, such that their height from the top surface part 16 is about 2.8 mm. Owing to this arrangement, at the peripheral edge part of the top surface part 16 of the cap 10, the first ribs 18*a* and the second ribs 18*b* extend astride from the inner surface of the top surface part 16 to the inner surface of the peripheral wall part 17 and protrude inwards of the cap 10 in such a manner as to be integral therewith.

The sectional configuration of each rib 18 and the number of arrangement spots of the ribs 18 are not limited to those mentioned above. However, because of efficient dispersion of the stress applied to the cap 10, prevention of the excessively large quantity of resign to be used and retention of favorable moldability, it is preferred that the width of the sectional configuration is set to 0.4 to 1.5 mm, and that the number of arrangement spots is set to 4 through 10 in the circumferential direction of the top surface part 16, depending on the size of the cap, the magnitude of the applicable stress, etc.

According to this embodiment, as shown in FIG. 1, the cap 10 is detachably screwed on the port neck part 13 of the container main body 12 where the male screw 15, a screw of two threads, is formed. The male screw 15 is constituted by one pair of ridges 15*a*, 15*b* to which the ridges 14*a*, 14*b* are mated. The one pair of ridges 15*a*, 15*b* spirally extend from radially opposing positions, as start points, on the radially opposite side of the outer peripheral surface of the port neck part 13, towards the distal end part in such a manner as to alternately overlap with each other, and then, terminate at radially opposing positions as terminal parts. The cap 10 is screwed on the port neck part 13 with the inner plug 21 which is fitted into the distal end opening of the port neck part 13 being interposed between the cap 10 and the port neck part 13. The inner plug 21 is a member which is made of synthetic resin. This inner plug 21 is adapted to prevent a large quantity of chlorine-based bleach from flowing out at once from the port neck part 13, so that an appropriate quantity of detergent may flow out of the outlet port 30 at the time of using the chlorine-based bleach held in the container main body 12. The inner plug 21 is fixedly mounted to the port neck part 13 in such a manner as to sandwich the upper end of the port neck part 13 between an outer ring wall 28 and an inner ring wall 29. The outlet port 30 for the chlorine-based bleach is formed and opened at a central area of the inner plug 21. In addition, a fitting ring part 22 to which the inside inner ring part 20 is inserted and tightly adhered at the time of attachment of the cap 10, is disposed at the central area of the inner plug 21, surrounding the periphery of the outlet port 30.

The cap 10 according to this embodiment is also used as a measuring tool. Since the chlorine-based bleach is once taken into the cap 20 for measurement and then used, the chlorine-based bleach adheres to the inner peripheral surface of the cap 10. Moreover, the cap 10 is repeatedly applied with stress by repetition of the attaching and detaching operation of the cap 10 to the port neck part 13 of the container main body 12. Accordingly the cap 10 is placed under the circumstance where environmental stress crack is liable to occur due to adverse effect of the chlorine-based detergent and repeated stress. Particularly, when an attempt is made for further tightening the cap 10 after the distal end of the outside inner ring part 19 is tightly abutted with the distal end surface of the port neck part 13 through the inner plug 21, stress is concentrically applied to the joint area between the top surface part 16 and the peripheral wall part 17 and the terminal area on the top surface part 16 side of the female screw 14. Thus, cracking tends to occur at those areas.

According to the cap 10 of this embodiment, owing to the above-mentioned construction, the occurrence of cracking can effectively be suppressed at those areas where stress is concentrically applied. That is, according to the cap 10 of this embodiment, since the ribs 18 projecting in such a manner as to be astride from the inner surface of the top surface part 16 to the inner surface of the peripheral wall part 17 are provided at eight spots in the circumferential direction, the joint area between the top surface part 16 and the peripheral wall part 17 can effectively be reinforced from the inside of the cap 10, the concentration of stress can effectively be dispersed, and the contact between the content liquid and the top surface part 16 can effectively be reduced, thereby easily preventing breakage of the cap 10 which would occur due to environmental stress crack at the joint area between the top surface part 16 and the peripheral wall part 17. Moreover, since the side surfaces on the top surface part 16 side of the spiral mated ridges 14*a*, 14*b* which constitute the female screw 14 are brought into contact with the valley bottom part 27 through the R-face 26 which is concavely curved, the areas of the basal end parts of the mated ridges 14*a*, 14*b* acting as a cantilever with respect to stress are increased to ease the stress applied to the basal end parts. Thus, the breakage of the cap 10 which would occur particularly at the terminal area on the top surface part 16 side of the female screw 14 due to environmental stress crack can be prevented from occurring.

Moreover, according to the cap 10 of this embodiment, since the female screw 14 is constituted by a screw of two threads which are composed of one pair of mated ridges 14*a*, 14*b*, the occurrence of cracking can effectively be suppressed at the terminal area on the top surface part 16 side of the female screw 14 where stress is concentrically applied. That is, although the mated ridges 14*a*, 14*b* acting as a cantilever with respect to the stress applied from the contacts between the mated ridges 14*a*, 14*b* of the female screw 14 and the mating ridges 15*a*, 15*b* of the male screw 15 are readily cracked at the basal end parts of the mated ridges 14*a*, 14*b*, the concentration of stress can be prevented by dispersing the stress, and the stress can effectively be eased, by supporting such stress at two spots of the one pair of ridges 14*a*, 14*b*.

Thus, according to the cap 10 of this embodiment, the cap can effectively be prevented from getting broken which would occur due to environmental stress crack without a need of increase in thickness of the cap 10.

The cap of the present invention is not limited to the above embodiment but many changes and modifications can be made. For example, the liquid to be held in the container main body is not necessarily a liquid which contains a surface active agent and sodium hypochlorite. Instead, it may be a liquid which contains at least a surface active agent. The female screw is not necessarily a screw of two threads. Instead, it may be a screw of three threads or a screw of four threads. Moreover, the inner plug is not necessarily provided at the upper end part of the port neck part at the time of screwing the cap.

Moreover, the ribs are not necessarily disposed in such a manner as to be sandwiched between the inner surface of the peripheral wall part and the outer surface of the outside inner ring part. Instead, ribs of various configurations may be employed as long as they are of the type which can be provided astride from the inner surface of the top surface part to the inner surface of the peripheral wall part.

The cap of the present invention will be described hereinafter in more detail by way of an example and a comparative example.

EXAMPLE 1 AND COMPARATIVE EXAMPLE 1

Figure 6A:
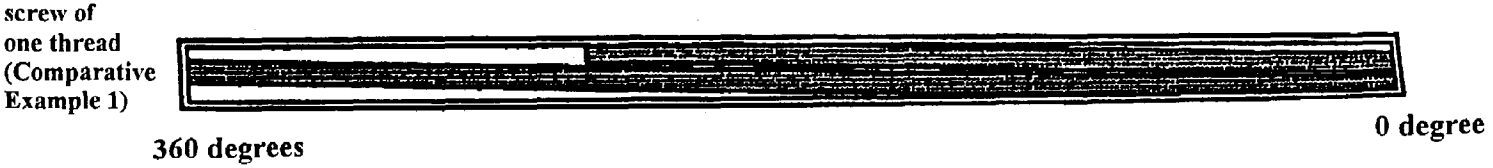
FIG. 6(*a*) is a development view along an inner peripheral surface of a cap for explaining a screw of one thread of Comparative Example 1.
Figure 6B:
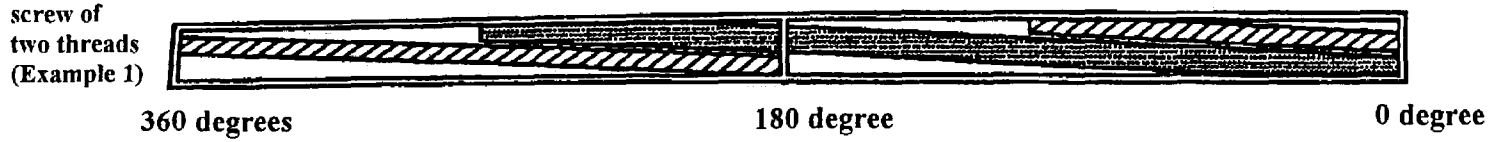

Ten caps each having a female screw which is a screw composed of two threads and having the same configuration as the cap 10 of the above-mentioned embodiment were prepared as samples of Example 1. The valley radius of the female screw was set to 15 mm, the thread angle θ at the distal end of each mated ridge was set to 80 degrees, and the thread height H of each mated ridge was set to 0.8 mm. On the other hand, as samples of Comparative Example 1, ten caps each having a female screw which is a screw composed of one thread and having the same configuration as the cap 10 of the above-mentioned embodiment were prepared. As in the case with Example 1, the valley radius of the female screw was set to 15 mm, the thread angle θ at the distal end of the mated ridge was set to 80 degrees, and the thread height H of the mated ridge was set to 0.8 mm. The screw of two threads of Example 1 and the screw of one thread of Comparative Example 1 are shown as development views along the inner peripheral surface of the cap in FIGS. 6(*a*) and 6(*b*). Evaluation of the effect of ESCR (environmental stress crack) was made according to the following Opening/Closing Method with respect to each of the ten samples of Example 1 and Comparative Example 1. The test results are shown in Table 1.

TABLE 1

| | Example 1 | Comparative Example 1 |
|---|---|---|
| Screw | Screw of two threads | Screw of one thread |
| F50(hr) | 1896 | 648 |

ESCR Test Method by Opening/Closing Method

Kitchen HEITER (trade name, manufactured by Kao Corporation) as liquid containing a surface active agent and sodium hypochlorite was measured by using ten sample caps in such a manner that the amount measured by each sample cap was enough to soak the female screw. Then, the measured liquid was discharged and a drop of the liquid was lightly removed so that the liquid could adhere to the inside of the cap. Each sample was screwed at a torque of 15 kgf·cm on the port neck part of the container main body which was designed in the same manner as the above embodiment in which a female screw composed of two or one thread was formed. Each container was kept for 24 hours (one day and night) at 50° C. Each container was taken out once a day and the presence or non-presence of cracking at the screw part of each sample was checked. The same procedure was repeatedly made and then the containers was kept again for 24 hours at 50° C. The time required until five samples which were equal to a half of the respective ten samples were cracked, was represented by F50, and ESCR time was evaluated.

According to the test results shown in Table 1, it is clear that the caps of Example 1 having a screw of two threads according to the present invention are increased about three times in ESCR time compared with the conventional cap of Comparative Example 1 having a screw of one thread, and this result shows that the ESCR effect of the caps of Example 1 is remarkably enhanced.

What is claimed is:

1. A cap to be attached to a port neck part of a container main body holding a liquid which contains a surface active agent, comprising:

an annular inner ring part; and a plurality of ribs formed between the annular inner ring part and a peripheral edge part of an inner surface of a top surface part of the cap, the plurality of ribs including ribs with a first configuration of a first thickness and ribs with a second configuration of a second thickness, different from the first thickness, radially extending astride from the inner surface of the top surface part to an inner surface of a peripheral wall part of the cap, and integrally projecting inwards, the first configuration of the ribs being different from the second configuration of the ribs, and the ribs with the first configuration and the ribs with the second configuration being alternately positioned.

2. The cap according to claim 1, wherein a female screw is formed in an inner peripheral surface of the cap, and said female screw is a screw in the form of two to four threads composed of spiral mated ridges of two to four threads.

3. The cap according to claim 1 or 2, wherein said liquid held in said container main body is a liquid which contains a surface active agent and a sodium hypochlorite.

4. The cap according to claim 2, wherein said mated ridges each are 80 to 120 degrees in thread angle and 1 to 15% of a valley radius of said female screw in thread height.

5. The cap according to claim 2, wherein a side surface on said top surface part side of said mated ridge is brought into contact with a valley bottom part through a concavely curved surface.

6. A cap configured to be attached to a neck part of a container main body, comprising:

an annular inner ring part;

an annular outer ring part;

an inner plug;

a fitting ring surrounding the annular inner ring part; and a plurality of first and second ribs radially extending from an inner surface of a top surface part of the cap to an inner surface of a peripheral wall part of the cap, the first ribs having a first height and the second ribs having a second height different from the first height, wherein when the cap is closed, a distal end of the annular outer ring part is configured to abut a distal end surface of the neck part on the outer side of the fitting ring, thereby sandwiching the inner plug and spreading the fitting ring with the annular inner ring part to seal the container.

7. The cap according to claim 6, wherein, when the cap is closed, an outer ring wall of a fitting part is pressed between the neck part and an inner peripheral wall part of the cap.

8. A cap to be attached to a port neck part of a container main body holding a liquid which contains a surface active agent, comprising:

an annular outside inner ring part;

an annular outer ring part; and a plurality of ribs formed between the annular outside inner ring part and a peripheral edge part of an inner surface of a top surface part of the cap, the plurality of ribs including ribs with a first configuration of a first thickness and ribs with a second configuration of a second thickness, different from the first thickness, radially extending astride from the inner surface of the top surface part to an inner surface of a peripheral wall part of the cap, and integrally projecting inwards, the first configuration of the ribs being different from the second configuration of the ribs, and the ribs with the first configuration and the ribs with the second configuration being alternately positioned.

* * * * *